US006647875B2

(12) United States Patent
Horikoshi

(10) Patent No.: US 6,647,875 B2
(45) Date of Patent: Nov. 18, 2003

(54) ROLLER STRUCTURE IN PRINTING PRESS

(75) Inventor: Kazumi Horikoshi, Ibaragi (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 09/835,227

(22) Filed: Apr. 13, 2001

(65) Prior Publication Data

US 2001/0029855 A1 Oct. 18, 2001

(30) Foreign Application Priority Data

Apr. 14, 2000 (JP) ..... 2000-113101

(51) Int. Cl.[7] ..... B41F 5/00; B41F 31/00; B41L 23/00

(52) U.S. Cl. ..... 101/216; 101/147; 101/148; 101/328; 101/348; 101/349.1

(58) Field of Search ..... 101/328, 348, 101/349.1, 216, 147, 148

(56) References Cited

U.S. PATENT DOCUMENTS

| | | | | | |
|---|---|---|---|---|---|
| 3,742,849 | A | * | 7/1973 | Greiner et al. | 101/220 |
| 4,290,360 | A | * | 9/1981 | Fischer | 101/148 |
| 4,724,764 | A | * | 2/1988 | MacPhee et al. | 101/451 |
| 4,753,168 | A | * | 6/1988 | Theilacker et al. | 101/177 |
| 4,833,983 | A | * | 5/1989 | Chen | 101/181 |
| 4,972,771 | A | * | 11/1990 | Weisberger et al. | 101/148 |
| 4,991,502 | A | * | 2/1991 | Akao | 101/148 |
| 5,025,726 | A | * | 6/1991 | Funabashi et al. | 101/352 |
| 5,158,017 | A | * | 10/1992 | MacConnell et al. | 101/148 |
| 5,465,819 | A | * | 11/1995 | Wellant et al. | 192/35 |
| 5,551,338 | A | * | 9/1996 | Wall et al. | 101/148 |
| 5,562,031 | A | * | 10/1996 | Garner et al. | 101/148 |
| 5,787,811 | A | * | 8/1998 | Achelpohl et al. | 101/349.1 |
| 5,809,891 | A | * | 9/1998 | Kemp | 101/425 |
| 5,823,109 | A | * | 10/1998 | Hummel et al. | 101/350.04 |
| 6,257,138 | B1 | * | 7/2001 | Bialek | 101/142 |

FOREIGN PATENT DOCUMENTS

| | | |
|---|---|---|
| JP | 2-019531 | 2/1990 |
| JP | 2-187336 | 7/1990 |

* cited by examiner

*Primary Examiner*—Edward Lefkowitz
*Assistant Examiner*—Marvin P Crenshaw
(74) *Attorney, Agent, or Firm*—Blakely, Sokoloff, Taylor & Zafman

(57) ABSTRACT

A roller structure in a printing press includes a dampening form roller, gear, belt, belt roller, clutch member, nut, movable element, and snap rings. The dampening form roller is supported rotatably and adapted to come into contact with a plate cylinder and oscillating roller, having different peripheral surface speeds, at their outer surfaces. The gear, belt, and belt roller transmit rotation of one of the plate cylinder and oscillating roller to the dampening form roller. The clutch member, nut, movable element, and snap rings connect/disconnect the gear, belt, and belt roller. When the gear, belt, and belt roller are disconnected by the clutch member, nut, movable element, and snap rings, the dampening form roller is rotatably driven by the other one of the plate cylinder and oscillating roller.

10 Claims, 4 Drawing Sheets

ROLLER STRUCTURE IN PRINTING PRESS

BACKGROUND OF THE INVENTION

The present invention relates to a roller structure in a printing press, in which the peripheral surface speeds (tangential velocity) of rotary members that are in contact with each other are set equal or are slightly changed.

For example, in a lithographic printing press, an image is formed on the surface of a plate mounted on the outer surface of a plate cylinder with ink and dampening water supplied by an ink unit and dampening unit. This image is transferred to paper passing between cylinders directly or through a blanket cylinder, thereby performing printing. In this printing operation, a dried ink film may be mixed in the ink to stick to the plate surface, or paper dust produced while cutting the paper may be scattered to attach to the plate surface. If printing is continued in this state, a printing trouble called hickey occurs in which some blank spots are undesirably formed in the printed portions.

In order to prevent hickey, Japanese Patent Laid-Open No. 2-187336 (reference 1) discloses an apparatus in which the peripheral speed of the plate cylinder and that of the dampening form roller are made different so the dampening form roller slips with respect to the plate cylinder, thereby removing hickey on the plate surface. In the apparatus disclosed in reference 1, a driving gear connected to the plate cylinder through a gear and a driven gear connected to the dampening form roller through a gear are loosely, rotatably mounted at a distance from each other on a gear shaft rotatably driven by a motor. A differential gear, which changes rotation of the driving gear and transmits the changed rotation to the driven gear so the transmission gear ratio changes in accordance with the rotational speed of the gear speed, is mounted on the gear shaft and interposed between the driving and driven gears.

In this conventional apparatus, the motor is stopped during printing operation, and the peripheral speed of the dampening form roller and that of the plate cylinder are set at the same value. When dust attaches to the plate surface, upon rotation of the motor, the peripheral speed of the dampening form roller is changed by the operation of the differential gear to become a speed different from the peripheral speed of the plate cylinder. The outer surfaces of the dampening form roller and plate cylinder slip against each other, thereby removing the dust.

Japanese Utility Model Laid-Open No. 2-19531 (reference 2) discloses another apparatus. The apparatus disclosed in reference 2 has a motor for driving a dampening form roller, two rotational speed detection means for detecting the rotational speeds of the dampening form roller and plate cylinder, and a controller for calculating the rotational speeds of the dampening form roller and plate cylinder on the basis of detection signals from the two rotational speed detection means. In this arrangement, when dust attaches to the surface of the plate, the controller is operated by button operation, so the peripheral speed of the dampening form roller is controlled to a speed different from the peripheral speed of the plate cylinder, so the dust attaching to the surface of the plate is removed.

In each of the above conventional dampening units, an exclusive motor is required for changing the peripheral speed of the dampening form roller to be different from that of the plate cylinder. The entire apparatus accordingly increases in size and the manufacturing cost also increases. The operation of changing the peripheral speed of the dampening form roller to a value different from that of the plate cylinder or returning it to the original value is performed during printing. Hence, the amount of water to be supplied to the plate cylinder changes, and the balance of the thickness of the water film is lost, leading to a defective printing. In the dampening unit disclosed in reference 2, since two rotational speed detection means are required for detecting the rotational speeds of the dampening form roller and plate cylinder, the manufacturing cost increases.

SUMMARY OF THE INVENTION

It is an object of the present invention to provide a roller structure in a printing press, in which downsizing is achieved.

It is another object of the present invention to provide a roller structure in a printing press, in which the manufacturing cost is reduced.

In order to achieve the above objects, according to the present invention, there is provided a roller structure in a printing press, comprising a roller supported rotatably and adapted to come into contact with two rotary members, having different peripheral surface speeds, at outer surfaces thereof, a transmission path for transmitting rotation of one of the rotary members to the roller, and driving source switching means for connecting/disconnecting the transmission path, wherein when the transmission path is disconnected by the driving source switching means, the roller is rotatably driven by the other one of the rotary members.

DESCRIPTION OF THE PREFERRED EMBODIMENTS

The present invention will be described in detail with reference to the accompanying drawings.

Figure 1:
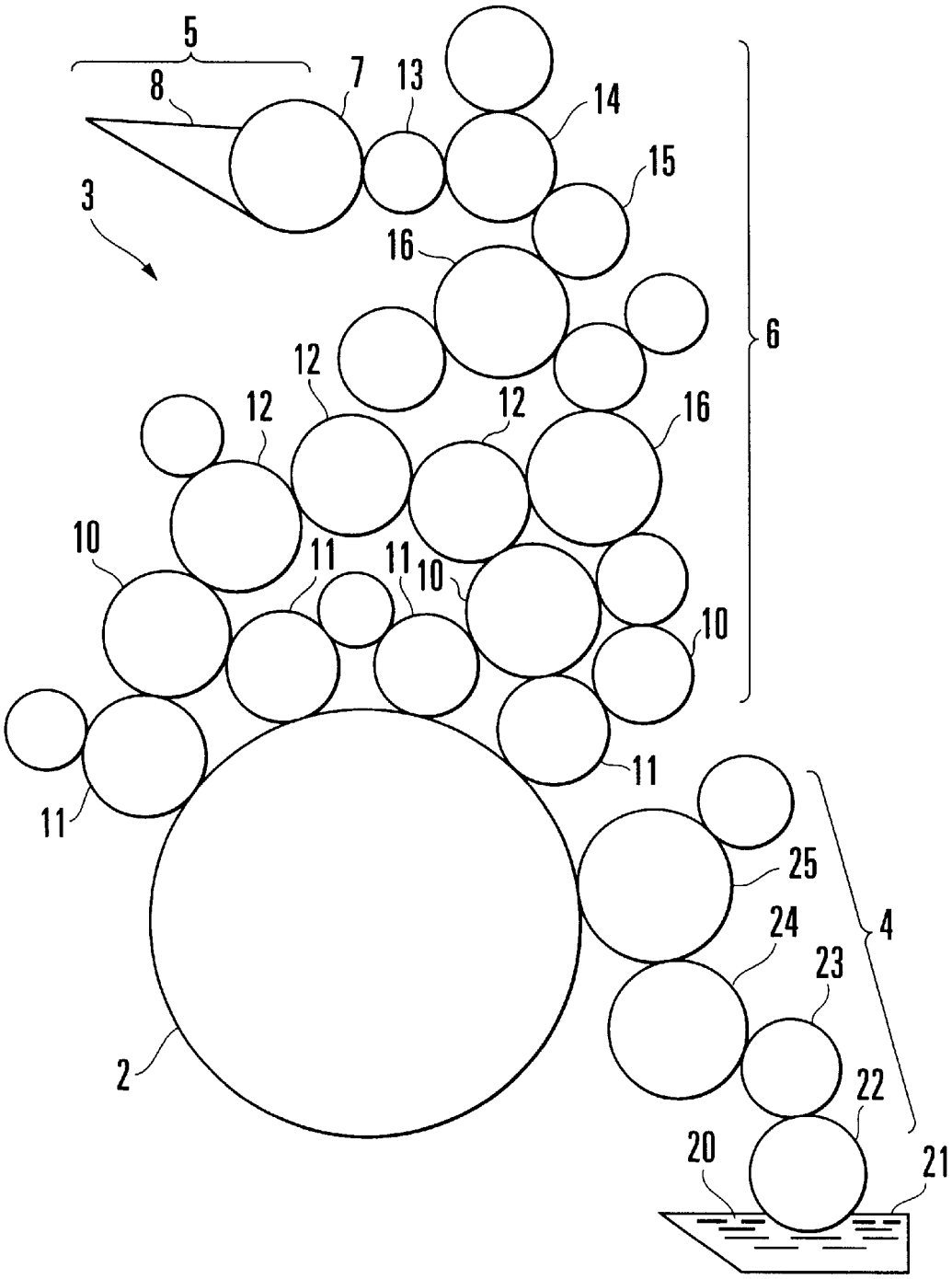
FIG. 1 is a side view of a printing press according to the first embodiment of the present invention.

FIG. 1 shows a printing press according to the first embodiment of the present invention. Referring to FIG. 1, a plate cylinder 2 with a plate mounted on its outer surface is rotatably supported between a pair of opposing frames (not shown) through bearings at its two ends. An ink unit 3 comprised of an ink supply unit 5, having an ink fountain roller 7 and ink fountain 8, and an ink roller group 6, and a dampening unit 4 are provided between the frames. The ink fountain 8 is comprised of a fountain key (not shown) supported to be movable with respect to the outer surface of the ink fountain roller 7, a blade (not shown) supported on the fountain key, and a pair of opposing ink dams (not shown) arranged in the axial direction of the ink fountain roller 7.

A pair of ink form rollers 11 respectively supported by a pair of oscillating rollers 10 (not shown), arranged separate from each other by a predetermined distance, through arms (not shown) are in detachable contact with the outer surface of the plate cylinder 2. Three distribution rollers 12 are arranged in line between the oscillating rollers 10 such that their outer surfaces are in contact with each other. An ink ductor roller 13 reciprocally moves between the ink fountain roller 7 and a distribution roller 14 to alternately come into contact with them. A distribution roller 15 is in contact with the distribution roller 14. These rollers 10, 11, 12, 13, 14, and 15, an oscillating roller 16, and the like make up the ink roller group 6.

The dampening unit 4 is comprised of a water pan 21 provided on the side of the plate cylinder 2 and storing dampening water 20, a water fountain roller 22 dipped in the dampening water 20, a metering roller 23 in contact with the water fountain roller 22, an oscillating roller 24 in contact with the metering roller 23, and a dampening form roller 25 in contact with the oscillating roller 24 and water fountain roller 22 alternately. In this roller structure, when the printing press drives the respective rollers to rotate, the peripheral speed of the plate cylinder 2 becomes slightly faster than that of the oscillating roller 24.

Figure 2:
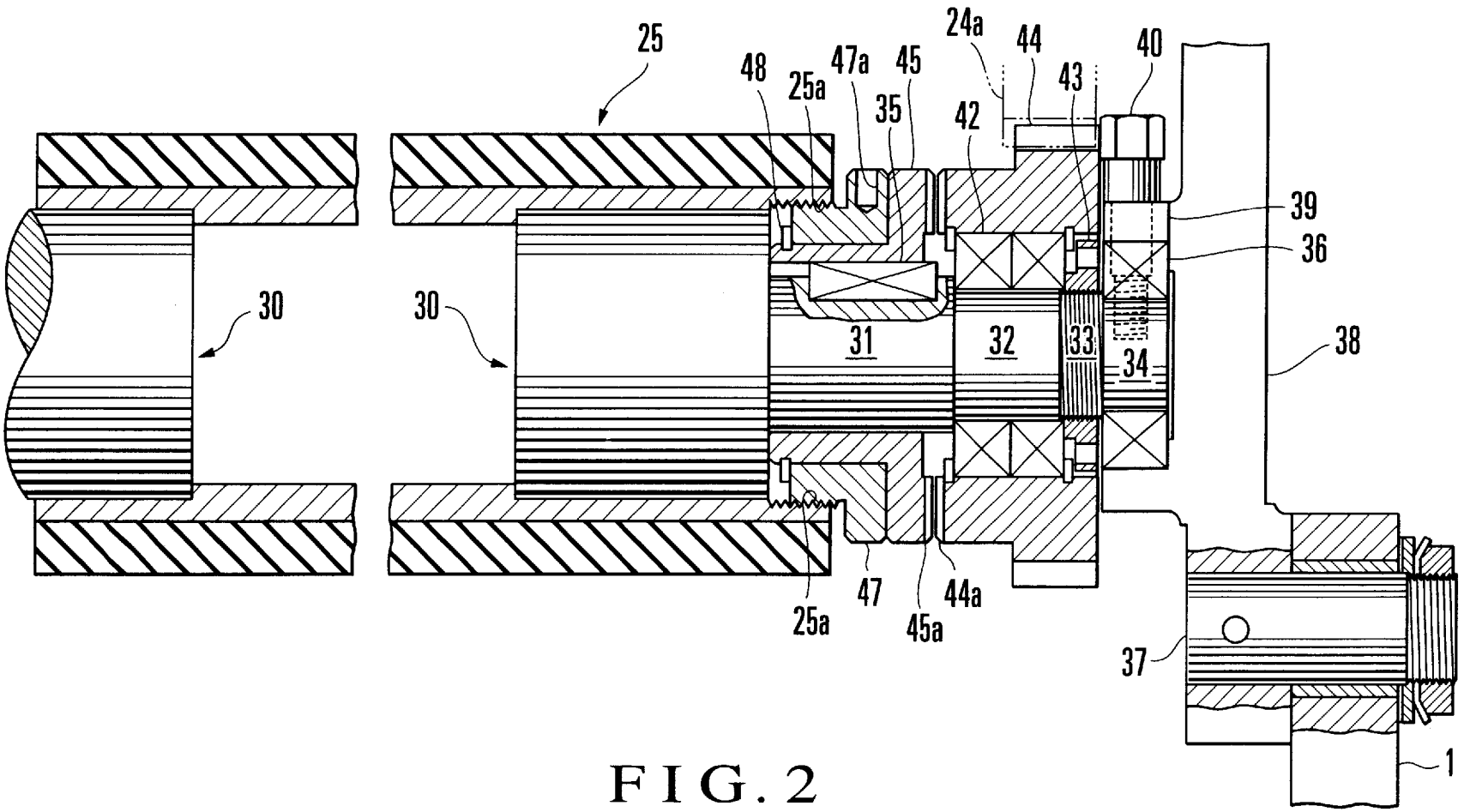
FIG. 2 is a sectional view of the main part of the dampening form roller shown in FIG. 1.

The structure of the dampening form roller 25 will be described with reference to FIG. 2.

The dampening form roller 25 is formed cylindrical and has threaded portions 25*a* on its inner surface at its two ends. One end of each of a pair of roller shafts 30 is fitted in and fixed to that inner surface of the dampening form roller 25 at each end which is more inside than the corresponding threaded portions 25*a*. First to fourth small-diameter portions 31, 32, 33, and 34, the diameters of which decrease stepwise, are integrally formed at the other end of each roller shaft 30. A key member 35 is fixed to the outer surface of the small-diameter portion 31, and a threaded portion is formed on the outer surface of the third small-diameter portion 33.

A bearing 36 is attached to the outer surface of the fourth small-diameter portion 34, and is axially supported by a substantially ring-like holder 39. A lever 38 is pivotally mounted on an arm 1 through a pin 37. When the holder 39 is fixed to the lever 38 with a bolt 40, the dampening form roller 25 is rotatably, axially supported by the lever 38. When the lever 38 is swung by a swing mechanism (not shown), the dampening form roller 25 can be thrown on/off the plate cylinder 2 and oscillating roller 24, and the nip pressure can be adjusted.

A bearing 42 is fixed to the outer surface of the second small-diameter portion 32, and is regulated from removing in the axial direction by a nut 43, threadably engaging with the third small-diameter portion 33. A gear 44 meshing with a gear 24*a* of the oscillating roller 24 is rotatably supported by the second small-diameter portion 32 through the bearing 42. A stepped engaging portion 44*a* is formed on the side surface of the gear 44 on the first small-diameter portion 31 side.

A stepped cylindrical clutch member 45 is supported by the first small-diameter portion 31 through the key member 35 such that it is movable in the axial direction while its rotation is regulated. A stepped engaging portion 45*a* is formed on the side surface of the clutch member 45 to oppose the engaging portion 44*a* of the gear 44. A nut 47 threadably engaging with the threaded portion 25*a* of the dampening form roller 25 is rotatably supported on the outer surface of the clutch member 45 such that its movement in the axial direction with respect to the key member 35 is regulated by a removal preventive member 48. A plurality of tool insertion holes 47*a* are formed in the outer surface of the nut 47.

The rotating operation of the dampening form roller 25 in the printing press with the above arrangement will be described.

Prior to the start of printing, the operator checks whether the image used for printing is the one where ghost (a phenomenon in which a blurred portion appears on part of the solid area) or streaking (a phenomenon in which dark lines extending in the widthwise direction of the paper appear in the solid area) tends to occur. If the operator determines that ghost or streaking tends to occur easily, he rotates the nut 47 to separate the engaging portion 45*a* of the clutch member 45 from the engaging portion 44*a* of the gear 44. Hence, the clutch between the dampening form roller 25 and gear 44 is disconnected, and rotation of the gear 44 is no longer transmitted to the dampening form roller 25 through the clutch member 45.

In this state, when printing is started, as the printing press is driven, the ink roller group 6 of the ink unit 3 and the plate cylinder 2 are rotated. Simultaneously, as the dampening unit 4 (not shown) is driven, the roller group of the dampening unit 4 is rotated. Also, the lever 38 is swung by the swing unit (not shown), and the dampening form roller 25 comes in contact with the plate cylinder 2 and oscillating roller 24.

Since the dampening form roller 25 is rotated by the friction of the plate cylinder 2 and oscillating roller 24, usually, the peripheral speed of the dampening form roller 25 takes a value between the peripheral surface speeds of the plate cylinder 2 and oscillating roller 24. However, since the nip pressure and friction with respect to the dampening form roller 25 are set such that those of the plate cylinder 2 are larger than those of the oscillating roller 24, the dampening form roller 25 is rotated at substantially the same peripheral speed as that of the plate cylinder 2. At this time, slippage occurs between the dampening form roller 25 and oscillating roller 24.

If it is determined that the image is the one in which hickey occurs easily, a tool is inserted in the tool insertion holes 47*a* of the nut 47, and the nut 47 is rotated. The nut 47 thus moves to come close to the gear 44, and accordingly the clutch member 45 also moves. Therefore, the engaging portion 45*a* of the clutch member 45 and the engaging portion 44*a* of the gear 44 engage with each other. In this state, when the printing press is driven, rotation of the gear 44 is transmitted to the roller shaft 30 through the clutch member 45, so the dampening form roller 25 is rotated integrally through the roller shaft 30.

In other words, the dampening form roller 25 rotates at the same peripheral speed as that of the oscillating roller 24. Since the peripheral speed of the oscillating roller 24 is slightly lower than that of the plate cylinder 2, the dampening form roller 25 is decelerated with respect to the plate cylinder 2. Thus, a step is formed between the plate cylinder 2 and dampening form roller 25, and dust attaching to the plate surface is removed by the dampening form roller 25, thus preventing hickey. If a clutch connection mode is set even when hickey does not occur easily, no particular problem arises. Thus, the clutch connection mode is employed as a normal printing mode.

According to this embodiment, when the dampening form roller 25 is to be decelerated with respect to the plate cylinder 2, the gear 44 and clutch member 45 rotatably supported on the roller shafts 30 are used. Therefore, no exclusive motor is required for driving the dampening form roller 25, so the manufacturing cost can be reduced.

Since the gear 44 and clutch member 45 are rotatably supported on the roller shaft 30, the overall apparatus does not increase in size. When the dampening form roller 25 is to be decelerated with respect to the plate cylinder 2, since printing is started after the clutch is switched while the printing press is stopped, the amount of water dipped up by the dampening form roller 25 does not change during printing. As a result, a water film with an appropriate thickness is formed on the outer surface of the plate cylinder 2, so that defective printing is prevented.

Since the clutch mechanism is employed, two types of gears, i.e., one with a gear and one without a gear, need not be prepared as the dampening form roller 25. While one roller is in use, the other roller which is not in use need not be stored. This can decrease the space and eliminate wasteful cost. Also, the operator need not perform exchange operation of these two types of rollers.

Figure 3:
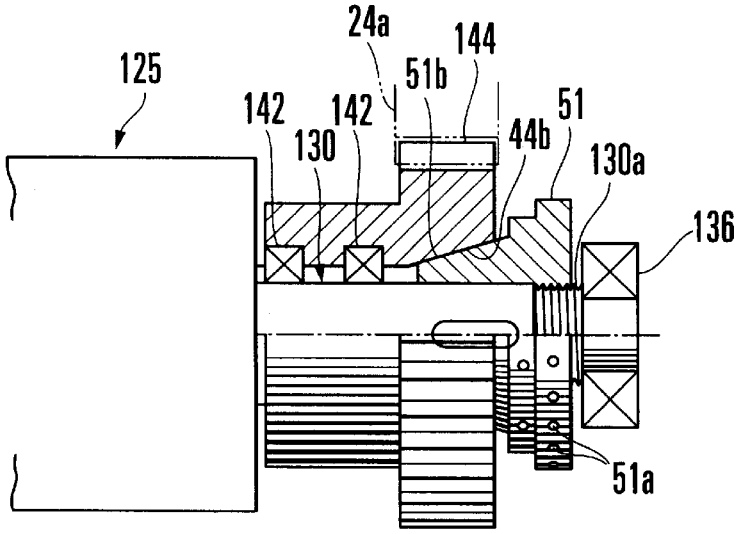
FIG. 3 is a side view of the main part of a dampening form roller according to the second embodiment of the present invention.

FIG. 3 shows the main part of a dampening form roller according to the second embodiment of the present invention.

Referring to FIG. 3, a roller shaft 130 has one end fitted in the inner surface of a dampening form roller 125. The other end of the roller shaft 130 forms a threaded portion 130*a*. An engaging hole 144*b* with a tapered inner wall surface is formed in the central portion of a gear 144 rotatably supported by the roller shaft 130. A substantially cylindrical clutch member 51 is rotatably supported on the other end of the roller shaft 130, and has a large number of tool insertion holes 51*a* in its outer surface. A threaded portion threadably engageable with the threaded portion 130*a* of the roller shaft 130 is formed on the inner surface, closer to the outside, of the clutch member 51. An engaging cylindrical portion 51*b* having a tapered tilt surface with the same tilt angle as that of the engaging hole 144*b* of the gear 144 is formed at the central portion of the inner surface of the clutch member 51.

In this arrangement, if the image to be used for printing is the one in which ghost or streaking tends to occur, a tool is inserted in the tool insertion holes 51*a* of the clutch member 51, and the clutch member 51 is rotated. Hence, the clutch member 51 moves away from the gear 144, and the engaging cylindrical portion 51*b* of the clutch member 51 and the engaging hole 144*b* of the gear 144, which have been engaged, are disengaged from each other.

When the clutch member 51 and gear 144 are disengaged from each other, rotation of the gear 144 is no longer transmitted to the roller shaft 130, and the dampening form roller 125 comes into contact with a plate cylinder 2 and oscillating roller 24. Thus, the dampening form roller 125 rotates at the same peripheral speed as that of the plate cylinder 2 because of the friction of the plate cylinder 2 and oscillating roller 24.

If the image is the one in which hickey occurs easily, the tool is inserted in the tool insertion holes 51*a* of the clutch member 51, and the clutch member 51 is rotated. Hence, the clutch member 51 moves close to the gear 144, and the engaging cylindrical portion 51*b* of the clutch member 51 and the engaging hole 144*b* of the gear 144 engage with each other. In this state, when the printing press is driven, rotation of the gear 144 is transmitted to the roller shaft 130 through the clutch member 51, and the dampening form roller 125 is rotated integrally through the roller shaft 130.

At this time, the dampening form roller 125 rotates at the same peripheral speed as that of the oscillating roller 24. As the peripheral speed of the oscillating roller 24 is slightly lower than that of the plate cylinder 2, the dampening form roller 125 is decelerated with respect to the plate cylinder 2. As a result, dust attaching to the plate surface is removed by the dampening form roller 125, and hickey is prevented.

Figure 4:
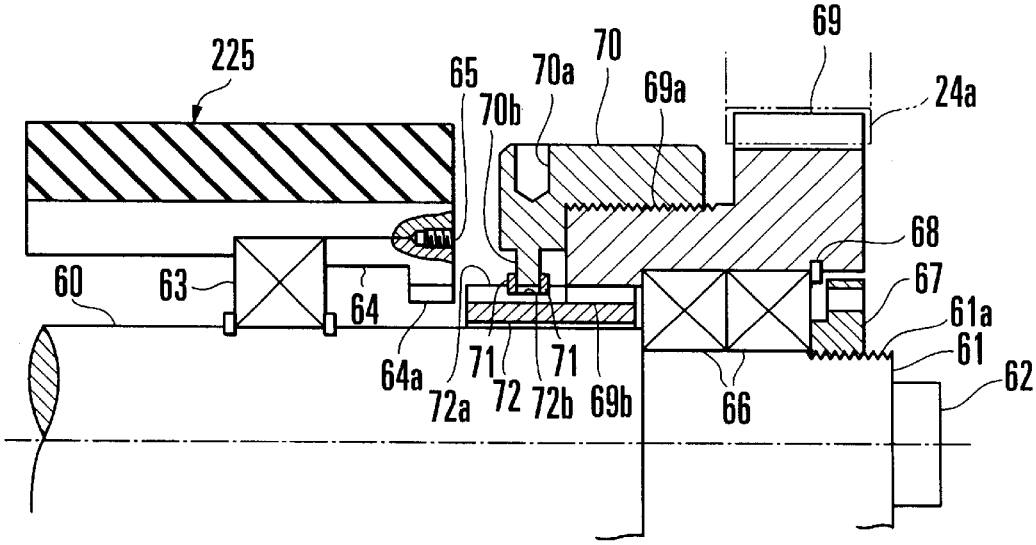
FIG. 4 is a side view of the main part of a dampening form roller according to the third embodiment of the present invention.

FIG. 4 shows the main part of a dampening form roller according to the third embodiment of the present invention.

The third embodiment is different from the first and second embodiments in that a roller shaft 60 is formed of one rod member, that the two ends of the roller shaft 60 are horizontally set on a pair of levers (not shown) to be nonpivotal, and that a dampening form roller 225 is rotatably supported by the roller shaft 60. More specifically, referring to FIG. 4, small-diameter portions 61 and 62, which are formed stepwise such that their diameters decrease gradually, are formed on each of the two ends of the roller shaft 60. The pair of small-diameter portions 62 are horizontally set on the levers (not shown) to be unrotatable.

A bearing 63 is fixed to the roller shaft 60, and the dampening form roller 225 is rotatably supported by the roller shaft 60 through the bearing 63. A substantially cylindrical engaging portion 64 is fixed to the inner surface of the dampening form roller 225 at each of the two ends, and a gear portion 64*a* is formed on the inner surface, closer to the outside, of each engaging portion 64. A set screw 65 is threadably engaged between the inner surface of the dampening form roller 225 and the outer surface of the engaging portion 64. Rotation of each engaging portion 64 is reliably transmitted to the dampening form roller 225 through the corresponding set screw 65. Bearings 66 fixed to the outer surface of the small-diameter portion 61 of the roller shaft 60 are regulated from moving in the axial direction by a nut 67 threadably engaging with a threaded portion 61*a* on the outer side of the small-diameter portion 61.

A stepped gear 69 meshing with a gear 24*a* of an oscillating roller 24 is rotatably supported by the small-diameter portion 61 through the bearings 66, and is regulated from moving in the axial direction by a removal preventive member 68. A threaded portion 69*a* is formed on the outer surface of the step of the gear 69 on the dampening form roller 225 side, and a gear portion 69*b* is formed on the inner surface of the gear 69. A substantially cylindrical movable element 70 meshes with the threaded portion 69*a* of the gear 69, and has a large number of tool insertion holes 70*a* in its outer surface. An engaging projection 70*b* projects from the inner surface of the movable element 70 toward the roller shaft 60. A pair of snap rings 71 are fixed to the two sides in the axial direction of the engaging projection 70*b*.

A cylindrical clutch member 72 is axially mounted on the roller shaft 60 projecting from the dampening form roller 225, and has a gear portion 72*a* on its outer surface. A ring-like groove 72*b* to engage with the snap rings 71 of the movable element 70 is formed in part of the gear portion 72*a* throughout the entire circumference.

With this arrangement, when a tool is inserted in the tool insertion holes 70*a* of the movable element 70 and the movable element 70 is rotated, the movable element 70 moves close to/away from the engaging portion 64. Thus, the clutch member 72 also moves together with the moving element 70 through the snap rings 71 close to/away from the engaging portions 64, and the gear portion 72*a* engages with and disengages from the gear portion 64*a* of the engaging portion 64. In this case, when one end of the gear portion 72*a* of the clutch member 72 engages with the gear portion 64*a* of the engaging portion 64, the other end of the gear portion 72*a* does not disengage from the gear portion 69*b* of the gear 69.

In this arrangement, if the image is the one in which ghost or streaking tends to occur, the movable element 70 is rotated to disengage the gear portion 64*a* of the engaging portion 64 from the gear portion 72*a* of the clutch member 72. Thus, rotation of the gear 69 is no longer transmitted to the dampening form roller 225, and the dampening form roller 225 is rotated by the friction forces of a plate cylinder 2 and oscillating roller 24. As a result, the dampening form roller 225 rotates at the same peripheral speed as that of the plate cylinder 2.

If the image is the one in which hickey occurs easily, the movable element 70 is rotated, so the gear portion 72*a* of the clutch member 72 engages with the gear portion 64*a* of the engaging portion 64. Hence, rotation of the gear 69 is transmitted to the dampening form roller 225 through the clutch member 72. The dampening form roller 225 rotates at the same peripheral speed as that of the oscillating roller 24. Since the peripheral speed of the oscillating roller 24 is slightly lower than that of the plate cylinder 2, the dampening form roller 225 is decelerated with respect to the plate cylinder 2, and dust attaching to the plate surface is removed by the dampening form roller 225.

Figure 5:
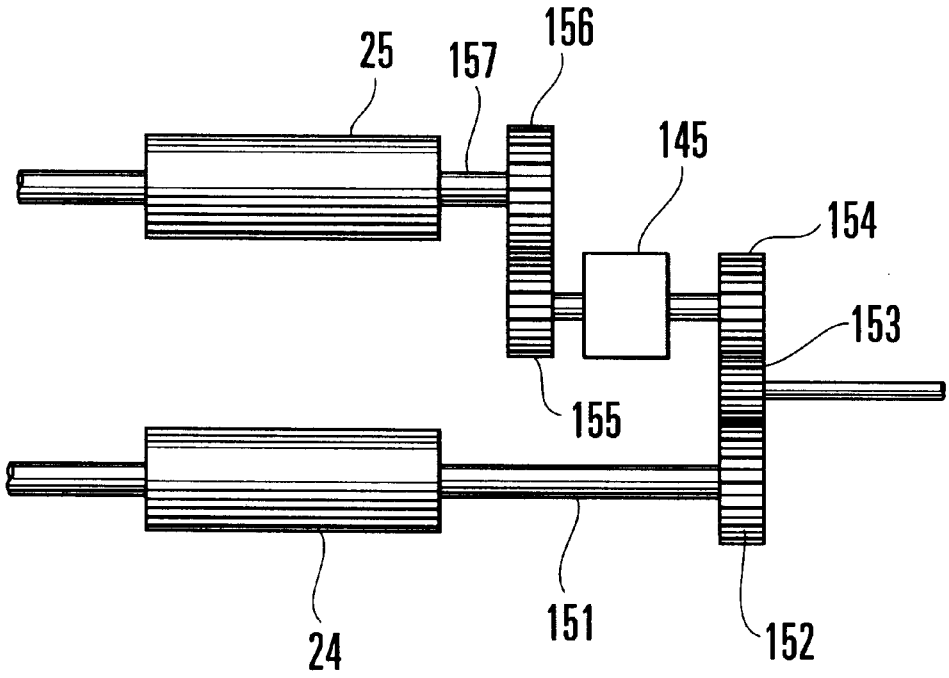
FIG. 5 is a view schematically showing the arrangement of a modification in which a clutch mechanism is provided to a shaft different from the shaft of the dampening form roller.

In the above embodiments, the clutch member is provided coaxially with the dampening form roller 25. However, the present invention is not limited to this. For example, as shown in FIG. 5, a clutch mechanism 145 may be provided along a transmission path between a gear 152 on an oscillating roller 24 side and a gear 156 on a dampening form roller 25 side. In this case, a gear 152 which rotates together with the oscillating roller 24 through a shaft 151 meshes with a gear 154 through a gear 153. Also, a gear 156 which rotates together with the dampening form roller 25 through a shaft 157 meshes with a gear 155. Transmission of rotation between the gears 154 and 155 is connected/disconnected by the clutch mechanism 145.

Figure 6:
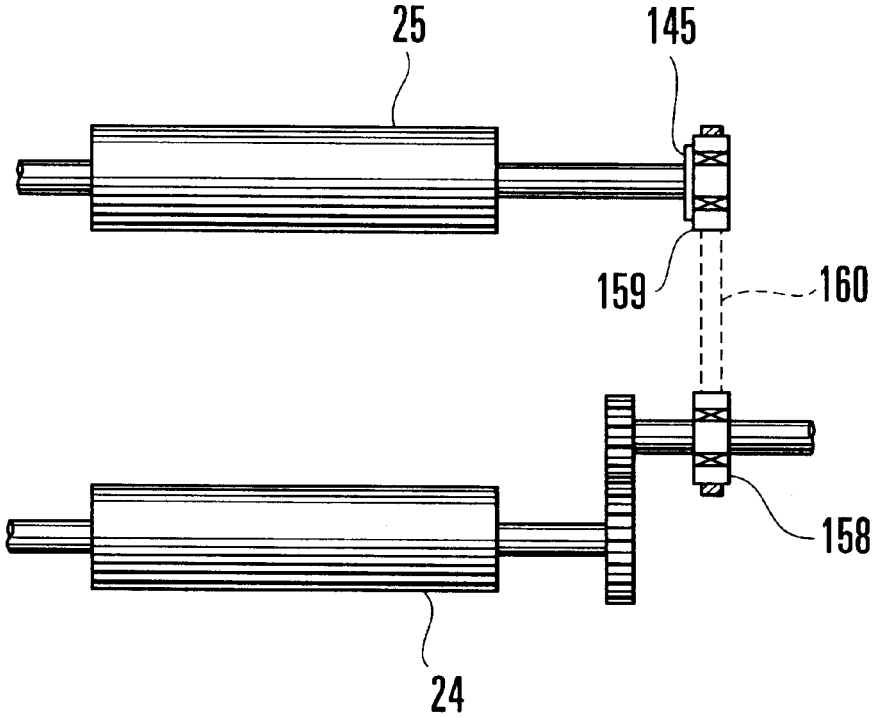
FIG. 6 is a view schematically showing the arrangement of a modification in which an oscillating roller and dampening form roller are connected to each other through a belt.

In the above embodiments, transmission of rotation along the transmission path between the oscillating roller 24 and dampening form roller 25 is performed with a gear mechanism (member). However, the present invention is not limited to this. For example, as shown in FIG. 6, a belt roller 158 which rotates in an interlocked manner with an oscillating roller 24 and a belt roller 159 which rotates together with a dampening form roller 25 may be connected to each other through a belt 160, and a clutch 145 may be interposed between the shaft of the dampening form roller 25 and the belt roller 159.

In the above embodiments, the present invention is applied to the dampening form roller 25, 125, or 225 of the dampening unit 4. Alternatively, the present invention can also be applied to the roller group of the ink unit 3.

As has been described above, according to the present invention, since no exclusive motor is required, the apparatus is downsized, and the manufacturing cost is reduced.

What is claimed is:

1. A roller structure in a printing press, comprising:

a roller supported rotatably and adapted to come into contact with two rotary members, having different peripheral surface speeds, at outer surfaces thereof;

a transmission path for transmitting rotation of one of said rotary members to said roller, wherein said transmission path includes a gear mechanism including a driving gear which rotates together with one of said rotary members, and wherein said gear mechanism has a gear member rotatably supported to be coaxial with said roller and meshing with said driving gear;

a roller shaft rotatable together with said roller and adapted to rotatably support said gear member;

driving source switching means for connecting/disconnecting said transmission path, wherein said driving source switching means is formed of a clutch mechanism for connecting/disconnecting transmission of rotation between one of said rotary members and said roller through said gear mechanism, and wherein said clutch mechanism has a cylindrical clutch member supported by said roller shaft to be rotatable and axially moveable and adapted to move close to/away from said gear member when connected to said roller, thereby disconnecting/connecting transmission of rotation from said gear member to said roller;

wherein said gear member has a first engaging portion on a side surface thereof, and said clutch member has a second engaging portion, on a side surface thereof, to engage with said first engaging portion, said first and second engaging portions being set in engaged and disengaged states with each other as said clutch member moves;

wherein an outer surface of said clutch member threadably engages with an inner surface of said roller at an end thereof when said first and second engaging portions are in the engaged and disengaged states; and wherein when said transmission path is connected by said driving source switching means, said roller, by a transmission of rotation from one of said rotary members through said transmission path, rotates at the peripheral surface speed which is different from the other of said rotary members, and when said transmission path is disconnected by said driving source switching means, said roller rotates at a peripheral surface speed, which is approximately the same as the other of said rotary members according to the frictional force between the circumferential surfaces.

2. A roller structure according to claim 1, wherein one of said rotary members rotates at a peripheral speed lower than that of the other one of said rotary members.

3. A roller structure according to claim 1, wherein said roller is a dampening form roller, and said rotary members are a plate cylinder and an oscillating roller.

4. A roller structure in a printing press, comprising:

a roller supported rotatably and adapted to come into contact with two rotary members, having different peripheral surface speeds, at outer surfaces thereof;

a transmission path for transmitting rotation of one of said rotary members to said roller, wherein said transmission path includes a gear mechanism including a driving gear which rotates together with one of said rotary members, and wherein said gear mechanism has a gear member rotatably supported to be coaxial with said roller and meshing with said driving gear;

a roller shaft rotatable together with said roller and adapted to rotatably support said gear member;

driving source switching means for connecting/disconnecting said transmission path, wherein said driving source switching means is formed of a clutch mechanism for connecting/disconnecting transmission of rotation between one of said rotary members and said roller through said gear mechanism, and wherein said clutch mechanism has a cylindrical clutch member supported by said roller shaft to be rotatable and axially moveable and adapted to move close to/away from said gear member when connected to said roller, thereby disconnecting/connecting transmission of rotation from said gear member to said roller;

wherein one of said gear member and said clutch member has an engaging cylindrical portion, at a central portion of a side surface thereof, with a tapered tilted surface, and the other one of said gear member and said clutch member has an engaging hole, at a central portion of a side surface thereof, with a tapered inner wall to engage with said engaging cylindrical portion, said engaging cylindrical portion and said engaging hole being set in engaged and disengaged states as said clutch member moves; and wherein when said transmission path is connected by said driving source switching means, said roller, by a transmission of rotation from one of said rotary members through said transmission path, rotates at the peripheral surface speed which is different from the other of said rotary members, and when said transmission path is disconnected by said driving source switching means, said roller rotates at a peripheral surface speed, which is approximately the same as the other of said rotary members according to the frictional force between the circumferential surfaces.

5. A roller structure according to claim 4, wherein one of said rotary members rotates at a peripheral speed lower than that of the other one of said rotary members.

6. A roller structure according to claim 4, wherein said roller is a dampening form roller, and said rotary members are a plate cylinder and an oscillating roller.

7. A roller structure in a printing press, comprising:

a roller supported rotatably and adapted to come into contact with two rotary members, having different peripheral surface speeds, at outer surfaces thereof;

a transmission path for transmitting rotation of one of said rotary members to said roller, wherein said transmission path includes a gear mechanism including a driving gear which rotates together with one of said rotary members, and wherein said gear mechanism has a gear member rotatably supported to be coaxial with said roller and meshing with said driving gear;

driving source switching means for connecting/disconnecting said transmission path, wherein said driving source switching means is formed of a clutch mechanism for connecting/disconnecting transmission of rotation between one of said rotary members and said roller through said gear mechanism, and said clutch mechanism connects/disconnects transmission of rotation between said gear member and said roller;

a roller shaft for rotatably supporting said roller and said gear member, wherein said clutch mechanism is formed of a cylindrical clutch member supported to be movable in an axial direction of said roller shaft and adapted to move close to/away from said roller when connected to said gear member, thereby connecting/disconnecting transmission of rotation from said gear member to said roller;

wherein said clutch member has a gear portion, on an outer surface thereof, to engage with an inner surface of said gear member, and when said clutch member moves close to said roller, said gear portion is rotatably connected to said roller through an engaging member formed on an inner surface of said roller; and wherein when said transmission path is connected by said driving source switching means, said roller, by a transmission of rotation from one of said rotary members through said transmission path, rotates at the peripheral surface speed which is different from the other of said rotary members, and when said transmission path is disconnected by said driving source switching means, said roller rotates at a peripheral surface speed, which is approximately the same as the other of said rotary members according to the frictional force between the circumferential surfaces.

8. A roller structure according to claim 7, further comprising a movable element engageable with said clutch member when meshing with an outer surface of said gear member and adapted to move said clutch member close to/away from said roller in accordance with rotation.

9. A roller structure according to claim 7, wherein one of said rotary members rotates at a peripheral speed lower than that of the other one of said rotary members.

10. A roller structure according to claim 7, wherein said roller is a dampening form roller, and said rotary members are a plate cylinder and an oscillating roller.

* * * * *